US010682035B2

(12) United States Patent
Ji et al.

(10) Patent No.: US 10,682,035 B2
(45) Date of Patent: Jun. 16, 2020

(54) VACUUM CLEANER AND WATER CLEANING DEVICE

(71) Applicant: LG Electronics Inc., Seoul (KR)

(72) Inventors: Heonpyeong Ji, Seoul (KR); Youngho Kim, Seoul (KR); Myungsig Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 338 days.

(21) Appl. No.: 15/743,150

(22) PCT Filed: Jun. 23, 2016

(86) PCT No.: PCT/KR2016/006704
§ 371 (c)(1),
(2) Date: Jan. 9, 2018

(87) PCT Pub. No.: WO2017/007152
PCT Pub. Date: Jan. 12, 2017

(65) Prior Publication Data

US 2018/0192846 A1 Jul. 12, 2018

(30) Foreign Application Priority Data

Jul. 9, 2016 (KR) ..... 10-2015-0097708

(51) Int. Cl.
*A47L 13/22* (2006.01)
*A47L 9/00* (2006.01)
(Continued)

(52) U.S. Cl.
CPC ..... *A47L 13/22* (2013.01); *A47L 9/00* (2013.01); *A47L 11/4083* (2013.01);
(Continued)

(58) Field of Classification Search
CPC ..... A47L 13/22; A47L 9/00; A47L 11/4083; A47L 11/4088; A47L 11/24; A47L 13/256; A47L 11/40
(Continued)

(56) References Cited

U.S. PATENT DOCUMENTS

2002/0096201 A1* 7/2002 Shaw ..... A47L 13/22 134/37

FOREIGN PATENT DOCUMENTS

EP 0997099 A2 * 3/2006
KR 200191130 8/2000
(Continued)

OTHER PUBLICATIONS

International Search Report in International Application No. PCT/KR2016/006704, dated Oct. 5, 2016, 4 pages (with English translation).

*Primary Examiner* — David Redding
(74) *Attorney, Agent, or Firm* — Fish & Richardson P.C.

(57) ABSTRACT

The present invention relates to a cleaner. In one aspect, the cleaner includes a nozzle assembly; a cleaner body connected to the nozzle assembly; and a water tank to which a cloth is attached, wherein the water tank is coupled to the nozzle assembly and is configured to supply water to the cloth.

The water tank comprises: a water storage unit to store water and having a water inlet; a water flow adjuster configured to close or open the water inlet and to adjust a water flow amount from the water storage unit to the cloth when closing the water inlet; and a stopper formed on the water storage unit to limit a rotation of the water flow adjuster, wherein the water flow adjuster has a receiving groove to receive the stopper therein, wherein the receiving groove includes a delimitation portion to limit a rotation of the water flow
(Continued)

adjuster in a first direction and having a tilted surface to allow the stopper to be exited out of the receiving groove.

15 Claims, 13 Drawing Sheets

(51) Int. Cl.
*A47L 11/40* (2006.01)
*A47L 13/256* (2006.01)
*A47L 11/24* (2006.01)

(52) U.S. Cl.
CPC ..... *A47L 11/4088* (2013.01); *A47L 11/24* (2013.01); *A47L 13/256* (2013.01)

(58) Field of Classification Search
USPC ..... 15/320, 321
See application file for complete search history.

(56) References Cited

FOREIGN PATENT DOCUMENTS

| | | |
|---|---|---|
| KR | 200422221 | 7/2006 |
| KR | 10-2008-0040387 | 5/2008 |
| KR | 10-2011-0001124 | 1/2011 |
| KR | 10-2013-0129060 | 11/2013 |
| TW | 200932186 | 8/2009 |
| TW | 201434428 | 9/2014 |

* cited by examiner

VACUUM CLEANER AND WATER CLEANING DEVICE

CROSS-REFERENCE TO RELATED APPLICATIONS

This application is a National Stage application under 35 U.S.C. § 371 of International Application No. PCT/KR2016/006704, filed on Jun. 23, 2016, which claims the benefit of Korean Application No. 10-2015-0097708, filed on Jul. 9, 2015. The disclosures of the prior applications are incorporated by reference in their entirety.

TECHNICAL FIELD

The present invention relates to a cleaner and a water cleaning device.

BACKGROUND ART

The cleaner is used to remove a dust or waste for a clean environment.

The cleaner may be classified into a manual cleaner where the user grips and moves the cleaner, and an automatic cleaner where the cleaner moves on its own.

Further, the manual cleaner may be classified into a canister type cleaner, an upright type cleaner, a handy type cleaner, a stick type cleaner, etc.

As a prior art document, Korean Patent application publication No. 2001-0028651 (Apr. 6, 2001) discloses a water cloth device with a water injector.

In this document, the water cloth device includes a water tank having a water injecting hole and a water injector; a cylindrical shaft fixed on an upper part of the water case to be rotatable; and an operation knob for actuating the water injector and fixed to an end of the cylindrical shaft.

However, in this document, only when the user operates the knob, the water injector works. Thus, the user should frequently operate the knob during the cleaning process. This may lead to inconvenience for the user.

Further, a single knob operation determines the water injection amount. In order to adjust the water injection amount, multiple knob operations are needed. This may lead to inconvenience for the user.

DISCLOSURE

Technical Problem

The present invention is to provide a water cleaning device with a water flow amount adjustment and the cleaner having the water cleaning device.

Technical Solution

In one aspect, there is provided a cleaner comprising: a nozzle assembly; a cleaner body connected to the nozzle assembly; and a water tank to which a cloth is attached.

The water tank is coupled to the nozzle assembly and is configured to supply water to the cloth, wherein the water tank comprises: a water storage unit to store water and having a water inlet; a water flow adjuster configured to close or open the water inlet and to adjust a water flow amount from the water storage unit to the cloth when closing the water inlet; and a stopper formed on the water storage unit to limit a rotation of the water flow adjuster.

The water flow adjuster has a receiving groove to receive the stopper therein, wherein the receiving groove includes a delimitation portion to limit a rotation of the water flow adjuster in a first direction and having a tilted surface to allow the stopper to be exited out of the receiving groove.

In one implementation, the water flow adjuster is rotatably coupled to the water storage unit, wherein the water flow amount from the water storage unit to the cloth is adjusted based on a rotation direction and/or rotation angle of the water flow adjuster.

In one implementation, the receiving groove further includes a contact portion to limit a rotation of the water flow adjuster in a second direction opposite the first direction, wherein when the stopper contacts the contact portion, the water flow from the water storage unit to the cloth is disabled.

In one implementation, when the stopper is spaced from the contact portion, the water flow from the water storage unit to the cloth is enabled.

In one implementation, in a state which the water flow adjuster is inserted into the opening, the rotation of the water flow adjuster in the second direction at a predetermined angle disables the water flow from the water storage unit to the cloth, wherein in a state which the water flow adjuster is inserted into the opening, the rotation of the water flow adjuster in the first direction enables the water flow from the water storage unit to the cloth, wherein the water flow amount from the water storage unit to the cloth is adjusted based on a rotation angle of the water flow adjuster in the first direction.

In one implementation, the water flow adjuster includes: a first member having the receiving groove; and a second member is connected to the first member and rotatably coupled to the water storage unit, wherein the water storage unit has an engaging rib rotatably coupled to the second member.

In one implementation, the stopper protrudes from the engaging rib.

In one implementation, when the second member is engaged with the engaging rib, the first member surrounds the engaging rib.

In one implementation, the first member has a handle formed thereon for a user grip.

In one implementation, wherein the water storage unit has a guide configured to guide a vertical movement of the second member during the rotation of the second member.

In one implementation, wherein the water flow adjuster include a packing, wherein the water storage unit includes a water flow hole formed therein, and a packing-contact portion to contact the packing, wherein the water flow adjuster allows the packing to contact the packing-contact portion to disable a communication between an inner chamber of the water storage unit and the water flow hole, wherein the water flow adjuster allows the packing to be spaced from the packing-contact portion to enable the communication between the inner chamber of the water storage unit and the water flow hole.

In one implementation, the water storage unit has an opening and a water outlet is connected to the opening.

In one implementation, wherein the water outlet has an flow hole and an absorption member to absorb a portion of water discharged from the flow hole, wherein water staying in the absorption member is supplied to the cloth.

In one implementation, wherein the water outlet has a plurality of flow holes, wherein the absorption member passes through the plurality of flow holes and winds the water outlet.

In one aspect, there is provided a water supply device for a cleaner, the device comprising: a water outlet having a flow hole; a water storage unit communicated with the water outlet and having a water inlet; and a water flow adjuster configured to close or open the water inlet and to adjust a water flow amount from the water outlet; wherein the water storage unit has a stopper to limit a rotation of the water flow adjuster, wherein the water flow adjuster has a receiving groove to receive the stopper therein, wherein the receiving groove includes a contact portion to limit a rotation of the water flow adjuster in a first direction and a delimitation portion to limit a rotation of the water flow adjuster in a second direction and having a tilted surface to allow the stopper to be exited out of the receiving groove.

Advantageous Effects

In accordance with the present invention, the water flow adjuster may allow the adjustment of the water flow amount from water storage unit, to lead to a water supply to the cloth by an intended amount by the user. In this connection, the water flow adjuster may be rotated, to allow the user to adjust the water flow adjuster easily.

Further, using the water flow adjuster, the water flow may be blocked, to stop the water supply to the cloth when the water supply to the cloth is not necessary.

Further, the water flow adjuster may close or open the water inlet. Thus, it may dispense with a separate inlet and a separate cover to close or open the inlet. This may simplify the structure of a water supply device and, thus, reduce a cost thereof.

Further, the guide prevents a rapid water flow between the packing and contact portion when the packing is spaced from the contact portion.

Further, when the absorption member is present at the flow hole, the absorption member may allow a stay of the water therein. This may increase the time to supply the same water amount to the cloth. Thus, the water spreads across the cloth completely and then, the water flowing in the cloth may fall down to the floor area. This may improve cleaning efficiency.

DETAILED DESCRIPTIONS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
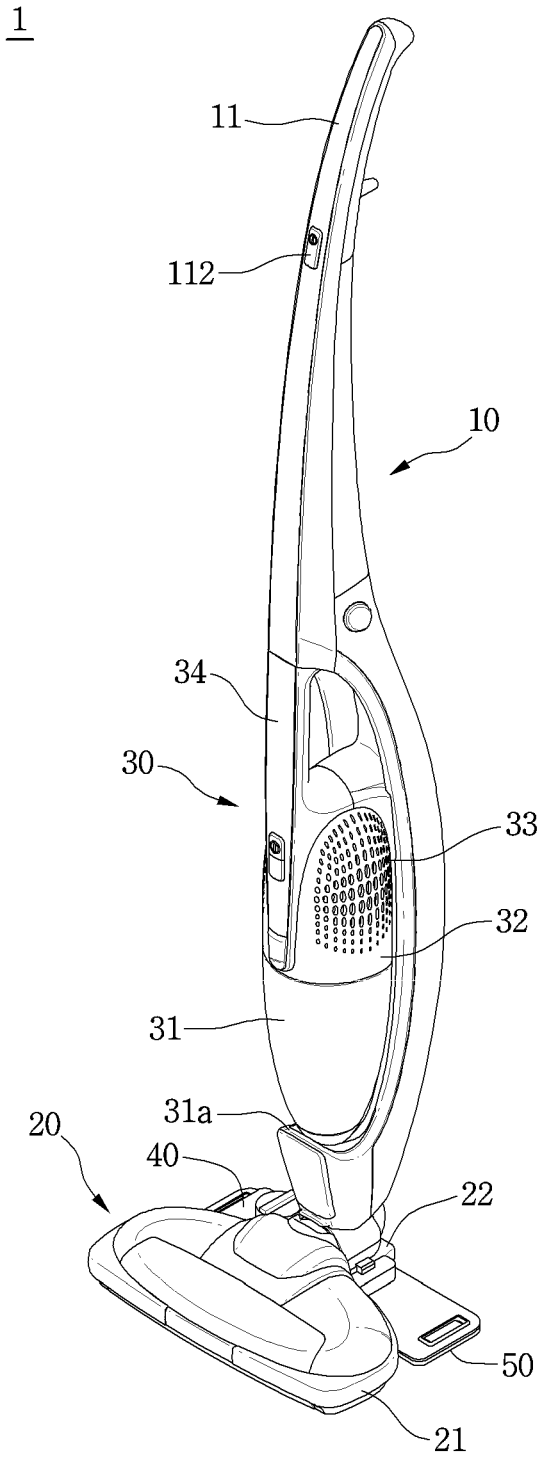
FIG. 1 is a perspective view of a cleaner in accordance with a first embodiment of the present disclosure.
Figure 2:
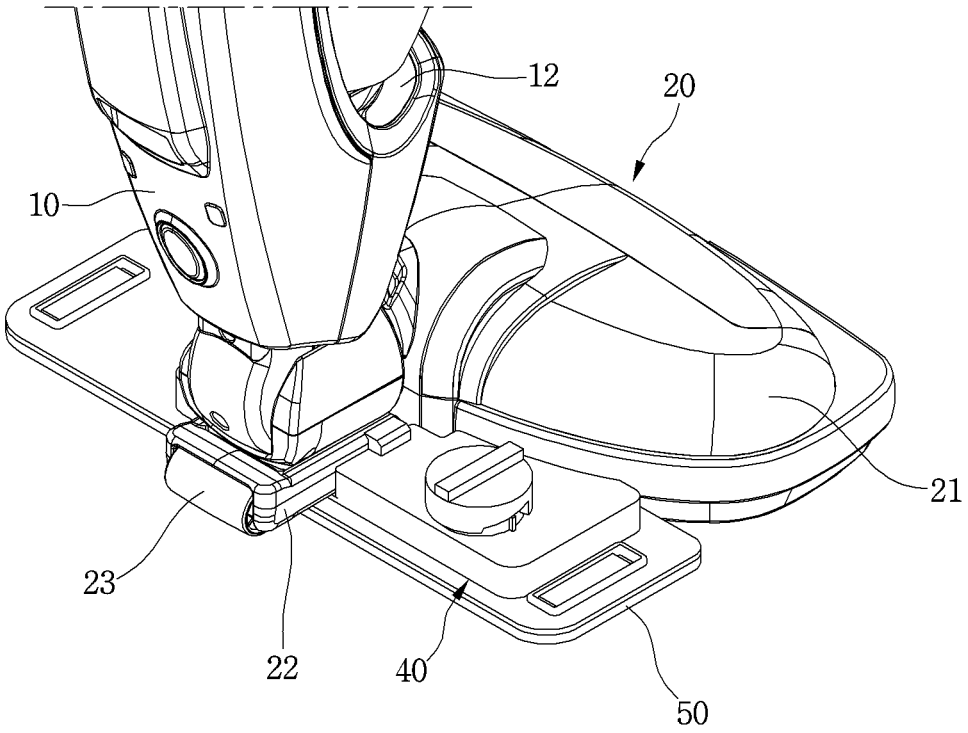
FIG. 2 shows an enlarged partial view of a combination between a water tank and a nozzle assembly of the cleaner in accordance with the first embodiment of the present disclosure.

FIG. 1 is a perspective view of a cleaner in accordance with a first embodiment of the present disclosure. FIG. 2 shows an enlarged partial view of a combination between a water tank and a nozzle assembly of the cleaner in accordance with the first embodiment of the present disclosure.

Referring to FIG. 1 and FIG. 2, the cleaner 1 in accordance with the first embodiment of the present disclosure may include a nozzle assembly 20 to suction a dust from a floor, and a cleaner body 10 movably coupled to the nozzle assembly 20.

The nozzle assembly 20 may allow the dust suctioned therein to flow into the cleaner body 10.

The cleaner 1 may further include a cleaning unit 30 removably coupled to the cleaner body 10.

The cleaning unit 30 may include a body 32 having a suction motor (not shown), and a dust collection unit 31 removably coupled to the body 32 to collect the dust separated from the air.

The dust collection unit 31 may include an air inlet 31*a* to receive an air from the cleaner body 10. The cleaner body 10 may have an air-communication unit 12 communicating with the air inlet 31*a*. The air-communication unit 12 may be disposed at a portion on which the air inlet 31*a* is mounded.

The dust collection unit 31 may include a cover (not shown) to open or close the air inlet 31*a*. The cover may open the air inlet 31*a* under a suction force of the suction motor. To the contrary, when the suction motor is not activated, the cover may close the air inlet 31*a*.

Thus, when the suction motor is not activated, the cover closes the air inlet 31*a*, to prevent the dust in the dust collection unit 31 from be discharged out of the air inlet 31*a*.

The body 32 may have an air outlet 33 to allow the air passing through the suction motor to be discharged out of the body 32. Further, the body 32 may have a handle 34 at an upper position thereof.

The cleaning unit 30 may further include a battery (not shown) to supply a power to the suction motor.

Thus, when the cleaning unit 30 is removed from the cleaner body 10, the user may perform cleaning using the cleaning unit 30.

Further, when the cleaning unit 30 is mounted on the cleaner body 10, the suction motor may be activated.

The cleaner body 10 may have a body handle 11. Around the body handle 11, a control unit 112 may be disposed. The user may control the suction motor in the cleaning unit 30 using the control unit 112.

The nozzle assembly 20 may include a nozzle body 21, and a connection 22 extending from the nozzle body 21 and rotatably coupled to the cleaner body 10.

The connection 22 may, for example, extend rearwards in a rear of the nozzle body 21.

The cleaner 1 may further include a water cleaning device. The water cleaning device may include a cloth 50, and a water tank 40 to which the cloth 50 is attached.

The water tank 40 may be coupled to the nozzle assembly 20.

The water tank 40 may supply water to the cloth 50 to allow the cloth 50 wet with water to remove the floor dust.

The cloth 50 may be attached to the water tank 40 at a bottom of thereof via adhering means (not shown) such as Velcro. The adhering means to attach the cloth 50 to the water tank 40 may not be limited thereto.

In this embodiment, as long as the water tank 40 is attached to the nozzle assembly 20, a structure of the nozzle assembly 20 and/or a presence/absence the cleaning unit 30 are not limited specifically.

Alternatively, the water tank 40 is not coupled to the cleaner but has a stick coupled to the water tank 40 to clean the floor using the cloth coupled to the water tank 40.

The water tank 40 may be disposed under the nozzle assembly 20. The water tank 40 may be at least partially disposed outside the nozzle assembly 20 when coupled to the nozzle assembly 20.

That is, as shown in FIG. 2, the water tank 40 may be partially disposed under the nozzle body 21 to be overlapped with the nozzle body 21. The water tank 40 may be partially disposed under the connection 22 to be overlapped with the connection 22. Further, the water tank 40 may be partially disposed not to be overlapped with both the nozzle body 21 and the connection 22.

Thus, using this embodiment, when the water tank 40 is coupled to the nozzle assembly 20, the water tank 40 is partially disposed outside the nozzle assembly 20 to allow a contact area between the cloth 50 and water tank 40 to increase. This may lead to increase the contact area between the cloth 50 and floor.

Using this embodiment, at a single time cleaning operation, the cloth 50 may remove the dust in a larger area on the floor.

Further, when the user puts one foot on a portion of the water tank 40 outside the nozzle assembly 20, the user may lift up the cleaner 1 to allow the water tank 40 to be removed from the nozzle assembly 20. Thus, the user may remove the water tank 40 from the cleaner 1 easily. In order to remove the water tank 40, the water tank 40 needs not a separate structure.

Further, when the water tank 40 contacts with the nozzle assembly 20, the contact area between the cleaner and floor area increases, to allow the cleaner to stand up on the floor area more stably in the cleaner standby mode.

The water tank 40 may be coupled to the nozzle body 21 and/or the connection 22.

The connection 22 may have one or more rear wheels 23 to allow the nozzle assembly 20 to move easily.

Figure 3:
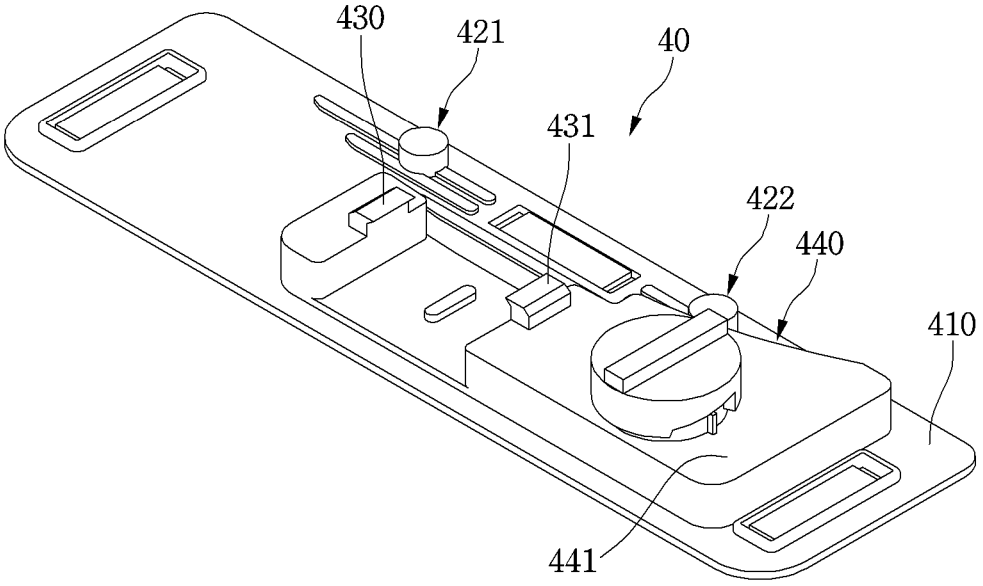
FIG. 3 is a perspective view of a water tank in accordance with a first embodiment of the present disclosure.
Figure 4:
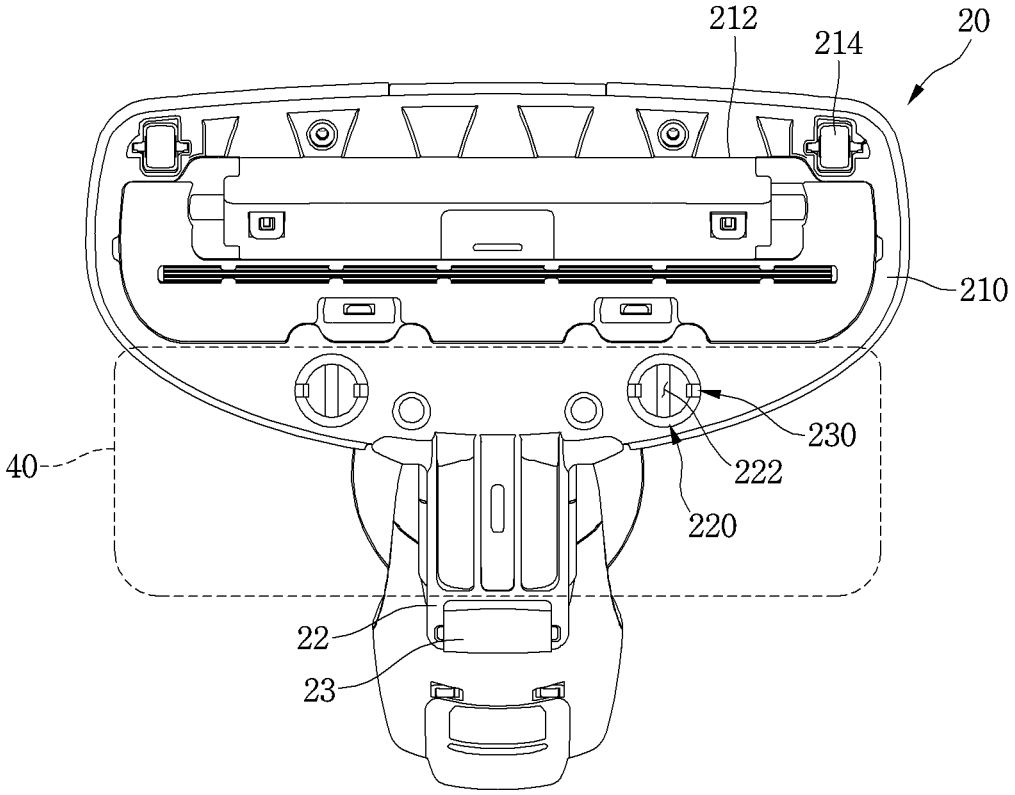
FIG. 4 is a bottom view of a nozzle assembly in accordance with a first embodiment of the present disclosure.

FIG. 3 is a perspective view of a water tank in accordance with a first embodiment of the present disclosure. FIG. 4 is a bottom view of a nozzle assembly in accordance with a first embodiment of the present disclosure.

Referring to FIG. 3 and FIG. 4, the nozzle body 21 may have an air inlet 212.

Further, the nozzle body 21 may have one or more front wheels 214 to move the nozzle assembly 20.

That is, the nozzle assembly 20 may have a plurality of wheels 23 and 214. The plurality of wheels 23, and 214 may include one or more front wheels 214 disposed at the nozzle body 21, and one or more rear wheels 23 disposed at the connection 22.

In order for the nozzle assembly 20 to move stably, a plurality of front wheels 214 may be disposed at the nozzle body 21. The plurality of front wheels 214 may be spaced from each other in a left-right direction.

In order to prevent the water tank 40 from blocking the inlet 212, the water tank 40 may be disposed in a rear of the air inlet 212. Further, in order to prevent interference between the water tank 40 and the plurality of wheels 23 and 214, the water tank 40 may be disposed in a rear of the front wheel 214 and in a front of the rear wheel 23.

That is, when the water tank 40 is coupled to the nozzle assembly 20, the water tank 40 may be disposed between the front wheel 214 and the rear wheel 23. Further, the water tank 40 may be disposed between the air inlet 212 and the rear wheel 23.

The water tank 40 may include a body plate 410.

On a bottom of the body plate 410, the cloth 50 may be disposed such that the cloth 50 is flat.

The body plate 410 may support the connection 22. That is, the connection 22 is seated on the body plate 410.

The water tank 40 may further include a coupling device coupled to the nozzle assembly 20.

The coupling device may include a first coupling unit 421 and 422 coupled to the nozzle body 21.

The first coupling units 421 and 422 may extend upwards from the body plate 410. In order for the water tank 40 to be firmly coupled to the nozzle body 21, a plurality of first coupling units 421 and 422 may be installed on the body plate 410. The plurality of first coupling units 421 and 422 may be spaced from each other in a left-right direction.

The nozzle body 21 may include receiving portion 220 to receive the first coupling unit 421 and 422. The receiving portion 220 may be recessed in the nozzle body 21.

When the plurality of first coupling units 421 and 422 are disposed on the water tank 40, the corresponding number of the receiving portions 220 may be disposed in the nozzle body 21. The plurality of receiving portions 220 may be spaced from each other in a left-right direction.

The nozzle body 21 may include hook members 230 coupled to the first coupling units 421 and 422 respectively when the first coupling units 421 and 422 are received in the receiving portions 220 respectively.

The hook members 230 may be fixed to the nozzle body 21. Each of the hook members 230 may at least partially protrude from each receiving portion 220.

During each first coupling unit 421 and 422 is inserted into each receiving portion 220, the hook member 230 may be elastically deformed by each first coupling unit 421 and 422 and then may be aligned with each hook receiving portion (not shown) of each first coupling unit 421 and 422, and, thus, may be received in each hook receiving portion (not shown) of each first coupling unit 421 and 422.

The coupling device may include a second coupling unit 430 and 431 coupled to the connection 22.

The second coupling unit 430 and 431 may extend upwards from the body plate 410. In order for the water tank 40 to be firmly secured to the nozzle body 21, a plurality of second coupling units 430 and 431 may be installed on the body plate 410. The second coupling units 430 and 431 may be spaced from each other in a left-right direction.

Each of the plurality of second coupling units 430 and 431 may include a hooking portion to be hooked to the connection 22.

When, between the plurality of second coupling units 430 and 431, the connection 22 is disposed, the hooking portion of each second coupling units 430 and 431 may be hooked to the connection 22. In one example, the hooking portion of each second coupling units 430 and 431 may contact the connection 22 at a top face thereof.

Since the connection 22 is located between the second coupling units 430 and 431 the nozzle assembly 20 may be prevented from being removed from the water tank 40 during the nozzle assembly 20 moves in a right or left direction.

That is, when the force to move the nozzle assembly 20 may be applied to the nozzle assembly 20 in a state in which the connection 22 is not located between the second coupling units 430 and 431, if a coupling force between the water tank 40 and the nozzle assembly 20 is smaller than a friction force between the cloth 50 attached to the water tank 40 and a floor area material, the nozzle assembly 20 may be removed from the water tank 40.

However, using this embodiment, during the nozzle assembly 20 moves in a right or left direction, the force to move the nozzle assembly 20 may be applied to one of the number of second coupling units 430 and 431. Thus, the nozzle assembly 20 may be prevented from being removed from the water tank 40 regardless of the friction force between the cloth 50 attached to the water tank 40 and the floor area material.

The water tank 40 may further include a water storage unit 440 to supply water to the cloth 50.

The water storage unit 440 may be formed of a chamber housing 441 integrated with the body plate 410, and a portion of the body plate 410.

Further, the chamber housing 441 may be integrated with one of the plurality of second coupling units 430 and 431 or may be spaced from the plurality of second coupling units 430 and 431.

Figure 5:
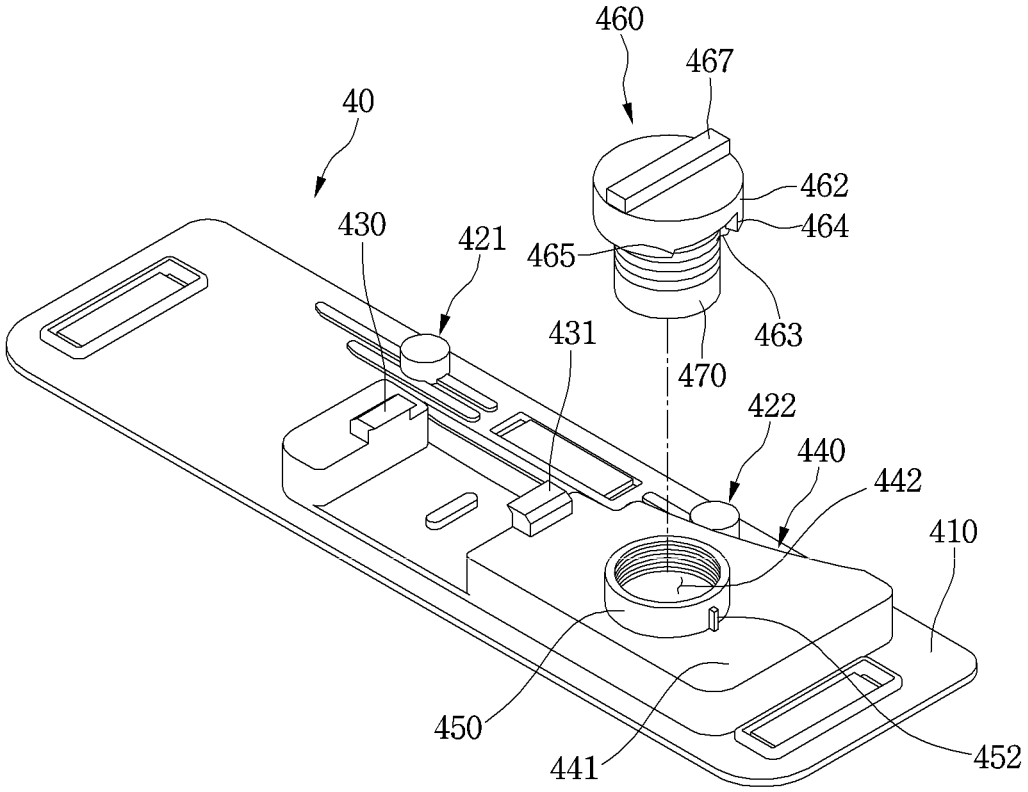
FIG. 5 is a cross-sectional view of a separation between a water flow adjuster and a water tank in accordance with a first embodiment of the present disclosure.
Figure 6:
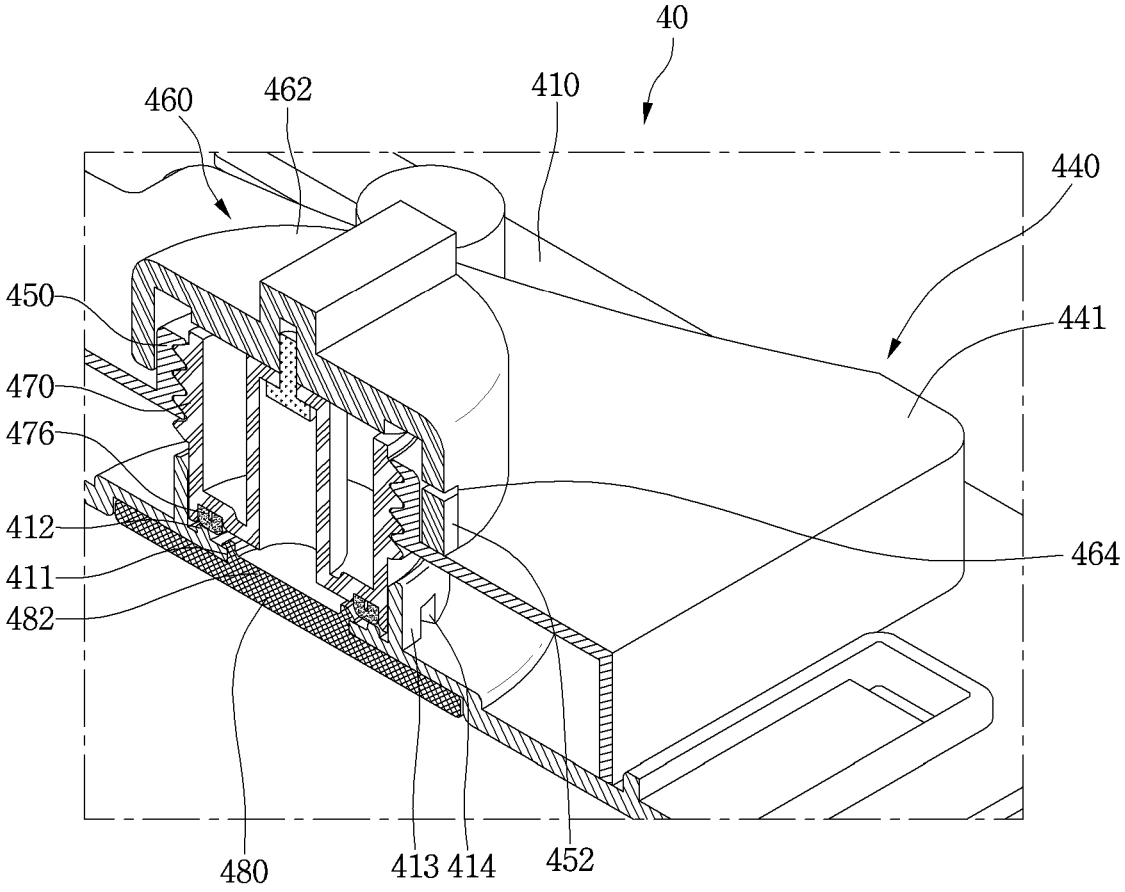
FIG. 6 is a cross-sectional view for showing an inner configuration of the water tank in accordance with the first embodiment of the present disclosure.
Figure 7:
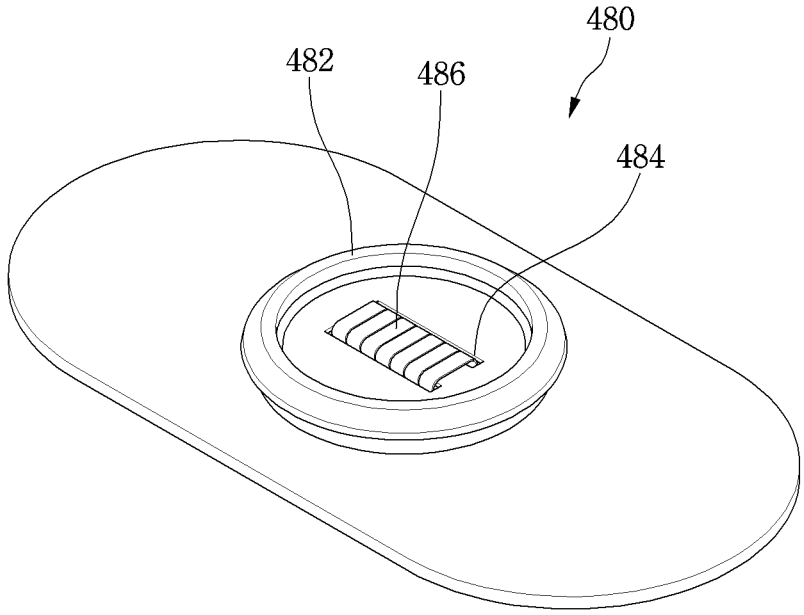
FIG. 7 is a perspective view of a water outlet in accordance with the first embodiment of the present disclosure.

FIG. 5 is a cross-sectional view of a separation between a water flow adjuster and a water tank in accordance with a first embodiment of the present disclosure. FIG. 6 is a cross-sectional view for showing an inner configuration of the water tank in accordance with the first embodiment of the present disclosure. FIG. 7 is a perspective view of a water outlet in accordance with the first embodiment of the present disclosure.

Referring to FIG. 5 to FIG. 7, the water storage unit 440 may further include a water inlet 442, and a water flow adjuster 460 to open or close the water inlet 442 and to adjust a water flow amount from the water tank 40.

In one example, the water inlet 442 may be formed in the chamber housing 441.

When the water flow adjuster 460 is removed from the water storage unit 40, water may be filled through the water inlet 442 into the water storage unit 440.

When the water flow adjuster 460 closes the water inlet 442, the water flow adjuster 460 may control the water flow amount to the cloth 50. Further, the water flow adjuster 460 may block the water flow to the cloth 50.

That is, when the water flow adjuster 460 enables the water flow to the cloth 50, the water flow adjuster 460 may vary the water flow amount thereto.

The water flow adjuster 460 may be rotatably coupled to the water storage unit 440. In one example, the water flow adjuster 460 may be coupled to the chamber housing 441. The user may rotate the water flow adjuster 460 to adjust the water flow amount easily.

The water flow adjuster 460 may include a first member 462, and a second member 470 coupled to the first member 462 and rotatably coupled to the water storage unit 440.

The second member 470 may be coupled to the first member 462 via a fastener such as a screw or an adhesive or a fusion. Alternatively, the second member 470 may be integrated with the first member 462.

The first member 462 may have a handle 467 for a user grip.

The second member 470 may be inserted through the water inlet 442 into the water storage unit 440. The water storage unit 440 may have an engaging rib 450 engaged with the second member 470. The second member 470 has an outer circumference engaged with an inner circumference of the engaging rib 450, in one example, in a screw type manner.

For the screw type engagement between the engaging rib 450 and the second member 470, the engaging rib 450 may be formed in a ring shape, and the second member 470 may be formed in a cylindrical shape. The inner circumference of the engaging rib 450 and the outer circumference of the second member 470 have threads.

When the second member 470 is engaged with the engaging rib 450, the first member 462 may surround the engaging rib 450. The user may grip the first member 462 or the handle 467 and rotate the first member 462 in a clockwise or counter-clockwise direction.

The water storage unit 440 may further include a stopper 452 to limit a rotation of the water flow adjuster 460 in one direction. The stopper 452 may protrude from the engaging rib 450. Alternatively, the stopper 452 may protrude from the water storage unit 440 while spaced from the engaging rib 450.

The water flow adjuster 460 may have a receiving groove 463 defined therein to receive the stopper 452 therein. The receiving groove 463 may be formed in the first member 462 of the water flow adjuster 460.

At both sides of the receiving groove 463, a contact portion 464 and a delimitation portion 465 are formed respective to contact the stopper 452.

In order to for the water flow adjuster 460 to block the water flow, the water flow adjuster 460 may rotate in a first direction (in a clockwise direction in the figure). During the rotation, the stopper 452 may contact the contact portion 464. When the stopper 452 contacts the contact portion 464, the rotation of the water flow adjuster 460 in the first direction may stop.

During the water flow adjuster 460 rotates in a second direction (in an anti-clockwise direction in the figure) opposite the first direction, the stopper 452 may contact the delimitation portion 465. A role of the delimitation portion 465 will be described.

The water flow adjuster 460 may further a packing 476. The water storage unit 440 may further include a packing-contact portion 412.

In one example, the packing 476 may be disposed on the second member 470. In one example, the packing-contact portion 412 may be disposed on the body plate 410.

When the water flow adjuster 460 rotates to block the water flow, that is, the stopper 452 contacts the contact portion 464, the packing 476 may contact the packing-contact portion 412.

The water storage unit 440 may further include an opening 411. A water outlet 480 may be coupled to the opening 411. In one example, the opening 411 may be formed in the body plate 410.

The water outlet 480 may include a flow hole 484. Further, the packing-contact portion 412 may extend to surround the opening 411 and the flow hole 484.

Thus, when the packing 476 contacts the packing-contact portion 412, a communication between the flow hole 484 and the inner chamber of the water storage unit 440 may be blocked. Thus, the water in the water storage unit 440 may not flow into the flow hole 484.

To the contrary, when the packing 476 is spaced from the packing-contact portion 412, a communication between the flow hole 484 and the inner chamber of the water storage unit 440 may be allowed. Water in the water storage unit 440 may flow between the packing 476 and the packing-contact portion 412 and then into the flow hole 484.

The packing-contact portion 412 may protrude from or be recessed in the body plate 410. As shown in FIG. 6, in one example, the packing-contact portion 412 may protrude from the body plate 410.

The packing-contact portion 412 may be formed in a ring shape, and, correspondingly, the packing 476 may be formed in a ring shape.

The water storage unit 440 may further include a guide 413 to guide the rotation of the water flow adjuster 460. In one example, the guide 413 may extend upwards from the body plate 410. In one example, the guide 413 may be formed in a cylindrical shape.

As described above, the second member 470 is engaged with the engaging rib 450 in a screw type manner, and, thus, the rotation of the second member 470 may allow the second member 470 to move vertically.

In this connection, the guide 413 may guide not only the rotation of the second member 470 but also the vertical movement of the second member 470. The guide 413 may have the height larger than that of the packing-contact portion 412.

The packing 476 may be vertically moved along with the rotation of the second member 470 to contact or be spaced from the packing-contact portion 412.

The guide 413 may prevent a rapid water flow between the packing 476 and packing-contact portion 412 when the packing 476 is spaced from the packing-contact portion 412.

When the water storage unit 440 has a level higher than the height of the guide 413, water in the water storage unit 440 may flow between an inner circumference of the guide 413 and the outer circumference of the second member 470 and then, flow between the packing 476 and the packing-contact portion 412.

The guide 413 may have a water pass hole 414 formed therein to allow the water flow between the packing 476 and the packing-contact portion 412 when the water storage unit 440 has a level lower than the height of the guide 413.

In one example, the water pass hole 414 may have a lowest level substantially flush with the top face of the body plate 410.

Further, a plurality of water pass holes 414 may be formed in the guide 413. The plurality of water pass holes 414 may be arranged along the circumference of the guide 413.

In one example, the water outlet 480 may be made of a rubber material and may be coupled to the opening 411 in the body plate 410. The water outlet 480 may include a coupling portion 482 coupled to the opening 411. A flow hole 484 may be formed in the coupling portion 482.

In order to prevent the rapid water flow through the flow hole 484, an absorption member 486 to absorb water is provided in the flow hole 484. Thus, the water staying in the absorption member 486 may be supplied to the cloth 50.

When the absorption member 486 is not present, the water may directly flow to the flow hole 484 and then flow to the cloth 50. In this case, before the water spreads across the cloth 50 completely, the water flowing in the cloth 50 may fall down to the floor area. This may reduce cleaning efficiency.

To the contrary, as in this embodiment, when the absorption member 486 is present at the flow hole 484, the absorption member 486 may allow a stay of the water therein. This may increase the time to supply the same water amount to the cloth 50. Thus, the water spreads across the cloth 50 completely and then, the water flowing in the cloth 50 may fall down to the floor area. This may improve cleaning efficiency.

The water outlet 480 may include a plurality of flow holes 484. In this connection, the absorption member 486 may be embodied as threads to pass through the number of flow holes 484 and to wind the water outlet 480.

Although not shown, the water outlet 480 may have one or more guide channels to allow water passing through the flow holes 474 to be spread radially.

Hereinafter, an operation of the water flow adjuster will be described.

Figure 8:
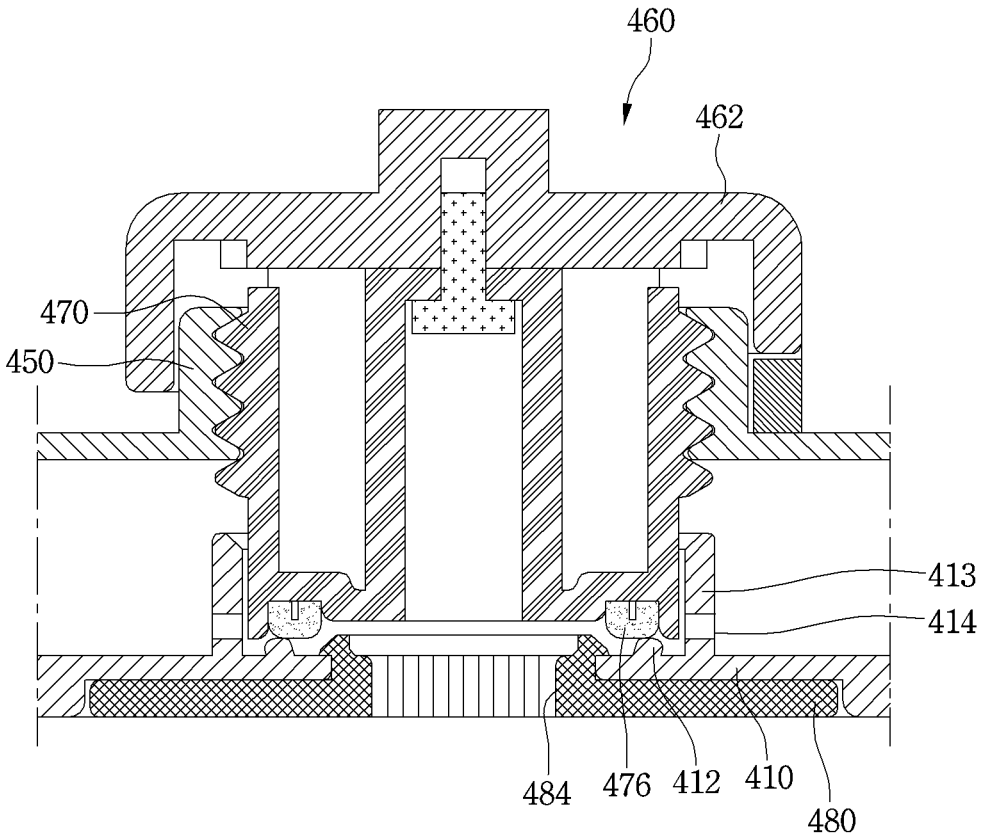
FIG. 8 is a cross-sectional view for illustrating a blocked water flow from the water tank using the water flow adjuster in accordance with the first embodiment of the present disclosure.
Figure 9:
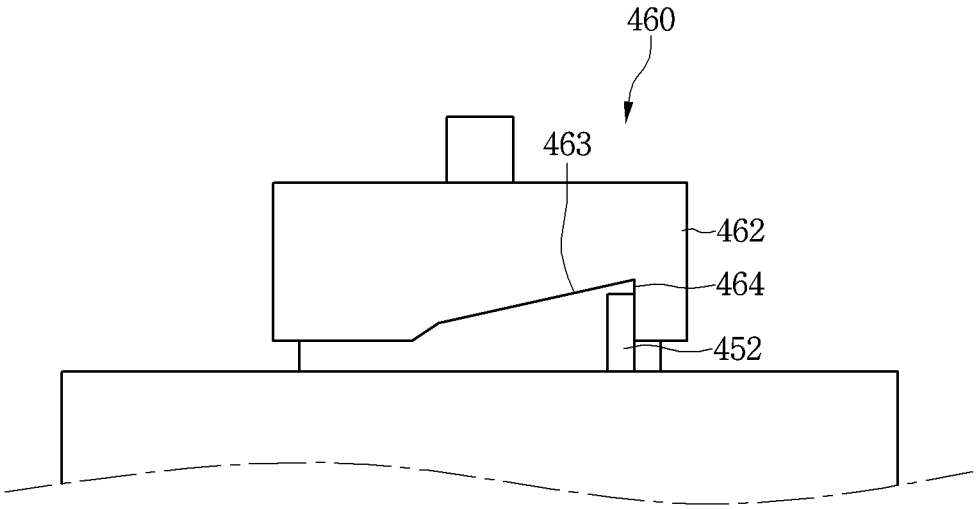
FIG. 9 is a cross-sectional view for illustrating a state in which a stopper contacts a contact portion.
Figure 10:
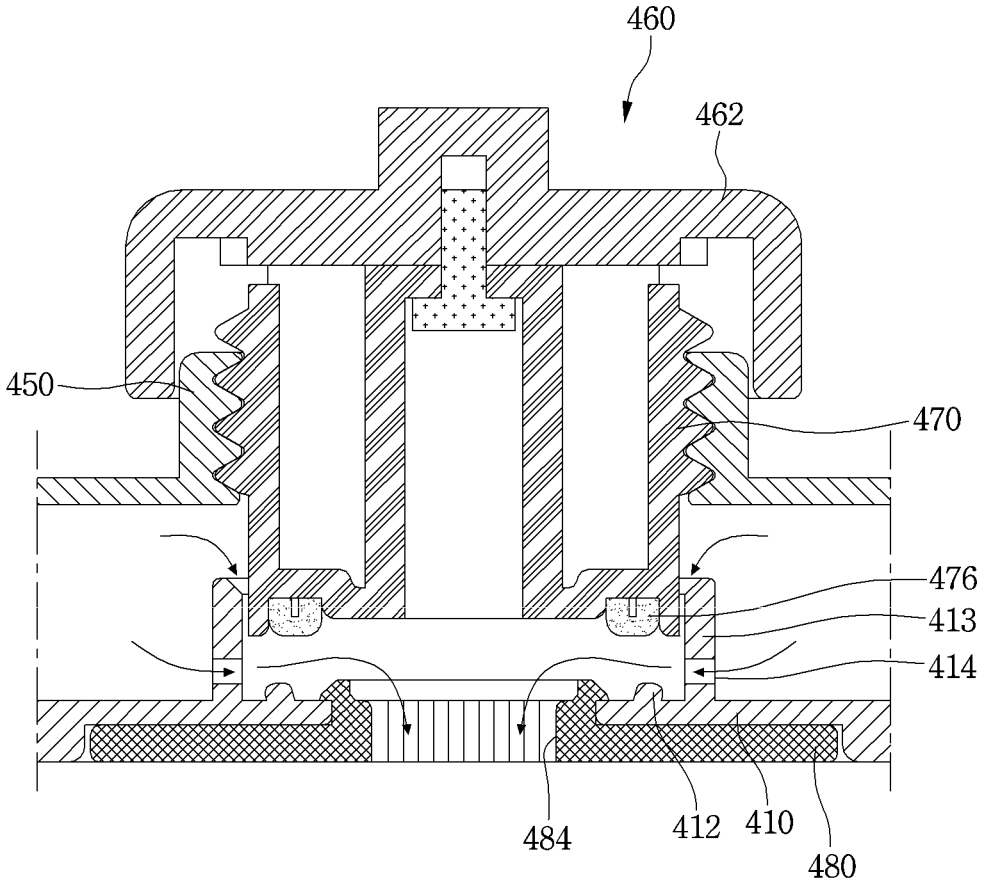
FIG. 10 is a cross-sectional view for illustrating a water flow in the water tank in accordance with the first embodiment of the present disclosure.
Figure 11:
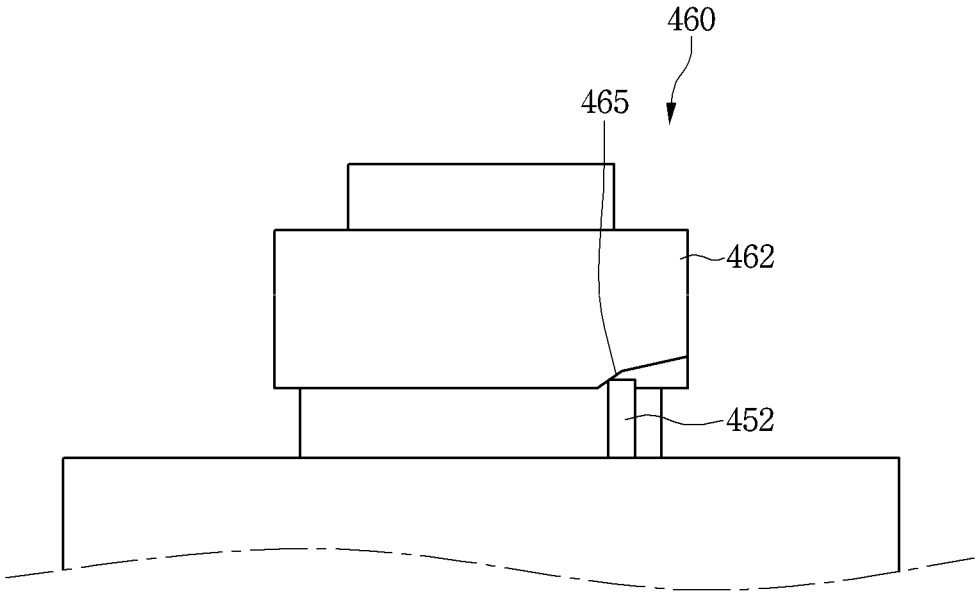
FIG. 11 is a cross-sectional view for illustrating a state in which a stopper contacts a delimitation portion.

FIG. 8 is a cross-sectional view for illustrating a blocked water flow from the water tank using the water flow adjuster in accordance with the first embodiment of the present disclosure. FIG. 9 is a cross-sectional view for illustrating a state in which a stopper contacts a contact portion. FIG. 10 is a cross-sectional view for illustrating a water flow in the water tank in accordance with the first embodiment of the present disclosure. FIG. 11 is a cross-sectional view for illustrating a state in which a stopper contacts a delimitation portion.

Referring to FIG. 1 to FIG. 10, when the water inlet 442 is open, the water may be filled through the water inlet 442 into the water storage unit 440.

Further, the water flow adjuster 460 may close the water inlet 442. That is, when the water flow adjuster 460 is inserted into the water inlet 442, the water flow adjuster 460 may be rotated in a first direction (clockwise direction in the figure).

During the water flow adjuster 460 is rotated in the first direction, the stopper 452 may be receive in the receiving groove 462 of the water flow adjuster 460. Further, during the water flow adjuster 460 is rotated in the first direction, the stopper 452 may contact the contact portion 464 as shown in FIG. 9, the rotation of the water flow adjuster 460 may stop.

Using this embodiment, a contact between the stopper 452 and the contact portion 464 may stop the rotation of the water flow adjuster 460, and, thus, it may be prevented for the user to rotate the water flow adjuster 460 in the first direction excessively.

When the stopper 452 contacts the contact portion 464, the packing 476 also may contact the packing-contact portion 412. Thus, the communication between the flow hole 484 and the inner chamber of the water storage unit 440 may be disabled to suppress the water flow to the flow hole 484.

In order to enable the water flow from the water storage unit 440, the water flow adjuster 460 may be rotate in a second direction (anti-clockwise direction).

When a rotation angle of the water flow adjuster 460 in the second direction opposite the first direction increases, the packing 476 may be spaced from the packing-contact portion 412. Thereafter, the space between the packing 476 and packing-contact portion 412 may increase.

To the contrary, a rotation angle of the water flow adjuster 460 in the first direction increases, the space between the packing 476 and the packing-contact portion 412 may decrease.

In this embodiment, as the space between the packing 476 and packing-contact portion 412 increases, the water flow amount from the water storage unit 440 may increase. That is, the user may rotate the water flow adjuster 460 in the first direction or second direction to adjust the water flow amount.

As in FIG. 10, when the rotation of the water flow adjuster 460 in the second direction allows the packing 476 to be spaced from the packing-contact portion 412, water from the water storage unit 440 may pass through the water pass hole 414 of the guide 413 and, then, flow between the packing 476 and the packing-contact portion 412 and, then, the flow hole 484.

When the water storage unit 440 has a level higher than the height of the guide 413, water may flow between the guide 413 and the second member 470 and, then, flow between the packing 476 and the packing-contact portion 412.

Then, the water from the flow hole 484 may flow to the absorption member 486 and, then, may flow to the cloth 50 coupled to the water tank 40.

In order to increase the water flow amount, the user may rotate the water flow adjuster 460 in the second direction. In order to decrease the water flow amount, the user may rotate the water flow adjuster 460 in the first direction.

During the water flow adjuster 460 is rotated in the second direction, the stopper 452 may contact the delimitation portion 465. During the user rotates the water flow adjuster 460 in the second direction, the stopper 452 contacts the delimitation portion 465. At this time, the user may stop rotating the water flow adjuster 460.

Since the user can perceive that the stopper 452 contacts the delimitation portion 465, it may be suppressed for the user to further continuously rotate the water flow adjuster 460 in the second direction to remove the water flow adjuster 460 from the water storage unit 440 unintendedly.

As shown in FIG. 9, when the stopper 452 contacts the delimitation portion 465, it is possible, of course, that the user may further rotate the water flow adjuster 460 in the second direction. This may raise up the water flow adjuster 460 to move the delimitation portion 465 along the top of the stopper 452. In this way, the stopper 452 is moved out of the receiving groove 463, and, thus, the water flow adjuster 460 may be removed from the water storage unit 440. In this connection, in order to achieve an easy exit of the stopper 452 from the receiving groove 463, the delimitation portion 456 may have a tilted surface.

Using this embodiment, the water flow adjuster may allow the adjustment of the water flow amount from water storage unit, to lead to a water supply to the cloth by an intended amount by the user. In this connection, the water flow adjuster may be rotated, to allow the user to adjust the water flow adjuster easily.

Further, using the water flow adjuster, the water flow may be blocked, to stop the water supply to the cloth when the water supply to the cloth is not necessary.

Further, the water flow adjuster may close or open the water inlet. Thus, it may dispense with a separate inlet and a separate cover to close or open the inlet. This may simplify the structure of a water supply device and, thus, reduce a cost thereof.

Although, in the above embodiment, the opening 411, packing-contact portion 412, and guide 413 are formed in the body plate 410, the present disclosure is not limited thereto. For example, the opening 411, packing-contact portion 412, and guide 413 may be formed in a single chamber housing acting as an independent water storage chamber. In this connection, the body plate 410 may have a further hole coupled to the opening 411.

Further, although, in the above embodiment, the packing contacts the packing-contact portion, the present disclosure is not limited thereto. For example, the outlet may be omitted, and the opening may act as the flow hole, and, thus, the packing may contact an edge portion of the opening.

Figure 12:
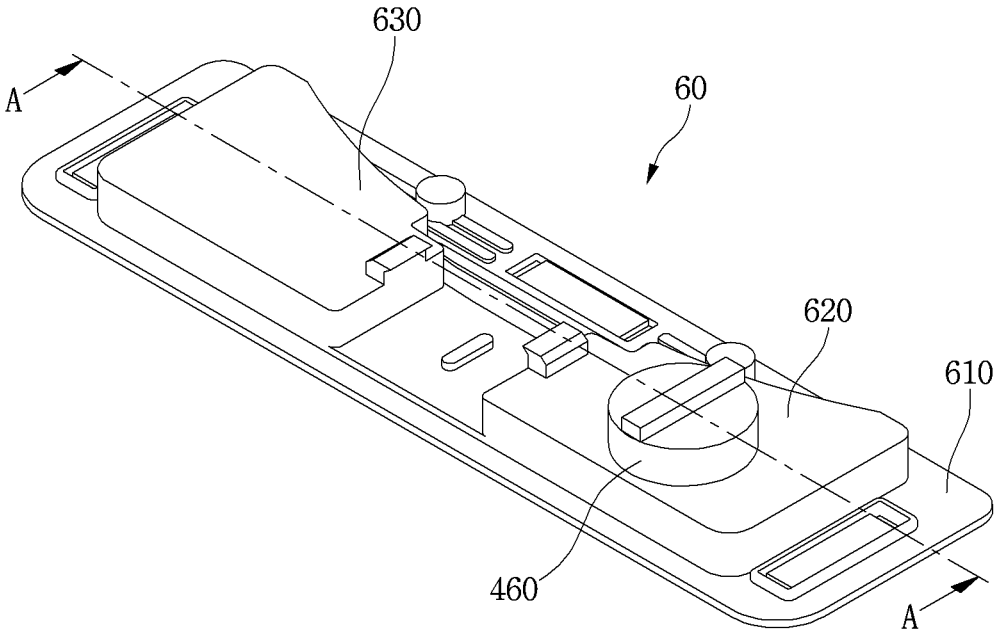
FIG. 12 is a perspective view of a water tank in accordance with a second embodiment of the present disclosure.
Figure 13:
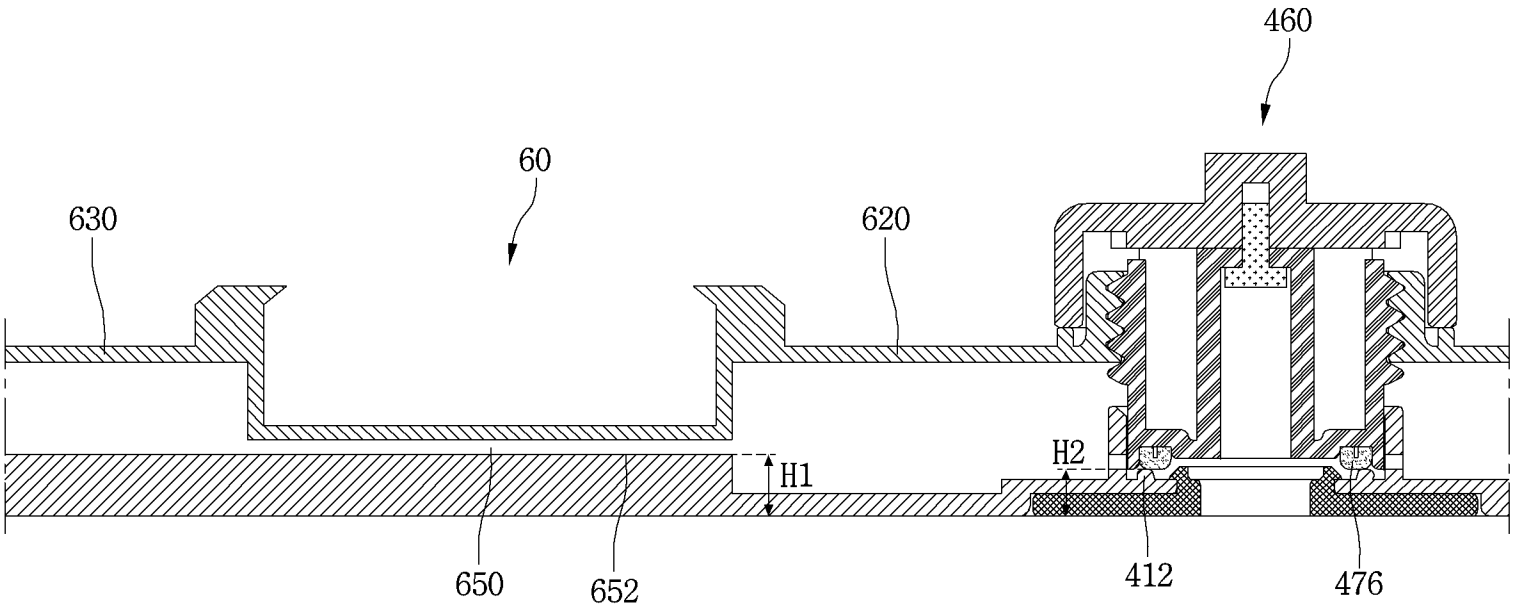
FIG. 13 is a cross-sectional view taken along a line A-A in FIG. 12.

FIG. 12 is a perspective view of a water tank in accordance with a second embodiment of the present disclosure. FIG. 13 is a cross-sectional view taken along a line A-A in FIG. 12.

This second embodiment may be similar to the first embodiment except that the water tank has a number of water storage units. Thus, hereinafter, only features of this second embodiment will be described.

Referring to FIG. 12 and FIG. 13, in this embodiment, the water tank 60 may include a body plate 610, and a number of water storage units 620, and 630.

The plurality of water storage units 620 and 630 may include a first storage unit 620 and a second storage unit 630.

In one example, the first storage unit 620 and second storage unit 630 may be spaced from each other horizontally. Between the first storage unit 620 and second storage unit 630, the connection (22 in FIG. 1) may be disposed. Further, each of the storages unit 620 and 630 may have the second coupling units (421 and 422 in FIG. 3).

The first storage unit 620 may have a water flow adjuster 460. The water flow adjuster 460 may be similar to that in the first embodiment in terms of a function, a structure and/or a relationship with the first storage unit 620.

The second storage unit 630 may have a water inlet 631, and a cover 632 to open or close the water inlet 631.

The first storage unit 620 and the second storage unit 630 may be fluid-communicated with each other via a connection channel 650.

For the water tank 60, a level H1 of the lowest point 652 of the connection channel 650 may be higher than a highest level H2 of the contact portion 412. Further, the level H1 of the lowest point 652 of the connection channel 650 may be higher than a level of the flow hole as a final water flow destination.

In this connection, the lowest point 652 of the connection channel 650 may be a point encountering with the first storage unit 620.

Using this embodiment where the level H1 of the lowest point 652 of the connection channel 650 is higher than the highest level H2 of the packing-contact portion 412, the level H1 of the lowest point 652 of the connection channel 650 is higher than a level of the flow hole as a final water flow destination, the water from the second storage unit 630 may flow to the first storage unit 620 easily and smoothly.

Using this embodiment where the water tank has the number of water storage units, the water storage capacity increases to increase a cleaning time and/or area, and/or to reduce a water filling frequency of the water storage unit.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or has) only those elements, or it may comprise (or include or have) other elements as well as those elements if there is no specific limitation. Unless otherwise specifically defined herein, all terms including technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein. Although embodiments have been described with reference to a number of illustrative embodiments thereof, it will be understood by those skilled in the art that various changes in form and details may be made therein without departing from the spirit and scope of the invention. Therefore, the preferred embodiments should be considered in descriptive sense only and not for purposes of limitation, and also the technical scope of the invention is not limited to the embodiments. Furthermore, all differences within the scope will be construed as being comprised by the amended claims.

What is claimed is:

1. A cleaner comprising:

a nozzle assembly;

a cleaner body connected to the nozzle assembly; and a water tank to which a cloth is attached, wherein the water tank is coupled to the nozzle assembly and is configured to supply water to the cloth, wherein the water tank comprises:

a water storage unit to store water and having a water inlet;

a water flow adjuster configured to close or open the water inlet and to adjust a water flow amount from the water storage unit to the cloth when closing the water inlet; and a stopper formed on the water storage unit to limit a rotation of the water flow adjuster, wherein the water flow adjuster has a receiving groove to receive the stopper therein, wherein the receiving groove includes a delimitation portion to limit a rotation of the water flow adjuster in a first direction and having a tilted surface to allow the stopper to be exited out of the receiving groove.

2. The cleaner of claim 1, wherein the water flow adjuster is rotatably coupled to the water storage unit, wherein the water flow amount from the water storage unit to the cloth is adjusted based on a rotation direction and/or rotation angle of the water flow adjuster.

3. The cleaner of claim 2, wherein the receiving groove further includes a contact portion to limit a rotation of the water flow adjuster in a second direction opposite the first direction, wherein when the stopper contacts the contact portion, the water flow from the water storage unit to the cloth is disabled.

4. The cleaner of claim 3, wherein when the stopper is spaced from the contact portion, the water flow from the water storage unit to the cloth is enabled.

5. The cleaner of claim 2, wherein in a state which the water flow adjuster is inserted into the opening, the rotation of the water flow adjuster in the second direction at a predetermined angle disables the water flow from the water storage unit to the cloth, wherein in a state which the water flow adjuster is inserted into the opening, the rotation of the water flow adjuster in the first direction enables the water flow from the water storage unit to the cloth, wherein the water flow amount from the water storage unit to the cloth is adjusted based on a rotation angle of the water flow adjuster in the first direction.

6. The cleaner of claim 1, wherein the water flow adjuster includes:

a first member having the receiving groove; and a second member is connected to the first member and rotatably coupled to the water storage unit, wherein the water storage unit has an engaging rib rotatably coupled to the second member.

7. The cleaner of claim 1, wherein the stopper protrudes from the engaging rib.

8. The cleaner of claim 6, wherein when the second member is engaged with the engaging rib, the first member surrounds the engaging rib.

9. The cleaner of claim 6, wherein the first member has a handle formed thereon for a user grip.

10. The cleaner of claim 6, wherein the water storage unit has a guide configured to guide a vertical movement of the second member during the rotation of the second member.

11. The cleaner of claim 1, wherein the water flow adjuster include a packing, wherein the water storage unit includes a water flow hole formed therein, and a packing-contact portion to contact the packing, wherein the water flow adjuster allows the packing to contact the packing-contact portion to disable a communication between an inner chamber of the water storage unit and the water flow hole, wherein the water flow adjuster allows the packing to be spaced from the packing-contact portion to enable the communication between the inner chamber of the water storage unit and the water flow hole.

12. The cleaner of claim 1, wherein the water storage unit has an opening and a water outlet is connected to the opening.

13. The cleaner of claim 12, wherein the water outlet has an flow hole and an absorption member to absorb a portion of water discharged from the flow hole, wherein water staying in the absorption member is supplied to the cloth.

14. The cleaner of claim 13, wherein the water outlet has a plurality of flow holes, wherein the absorption member passes through the plurality of flow holes and winds the water outlet.

15. A water supply device for a cleaner, the device comprising:

a water outlet having a flow hole;

a water storage unit communicated with the water outlet and having a water inlet; and a water flow adjuster configured to close or open the water inlet and to adjust a water flow amount from the water outlet;

wherein the water storage unit has a stopper to limit a rotation of the water flow adjuster, wherein the water flow adjuster has a receiving groove to receive the stopper therein, wherein the receiving groove includes a contact portion to limit a rotation of the water flow adjuster in a first direction and a delimitation portion to limit a rotation of the water flow adjuster in a second direction and having a tilted surface to allow the stopper to be exited out of the receiving groove.

* * * * *